US007361265B2

(12) United States Patent
de Almeida et al.

(10) Patent No.: US 7,361,265 B2
(45) Date of Patent: Apr. 22, 2008

(54) PROCESS FOR THE SELECTIVE HYDRODESULFURIZATION OF OLEFINIC NAPHTHA STREAMS

(75) Inventors: Rafael M. de Almeida, Rio de Janeiro (BR); Jefferson Roberto Gomes, Rio de Janeiro (BR)

(73) Assignee: Petroleo Brasileiro S.A.-Petrobras, Rio de Janeiro (BR)

( * ) Notice: Subject to any disclaimer, the term of this patent is extended or adjusted under 35 U.S.C. 154(b) by 587 days.

(21) Appl. No.: 10/385,432

(22) Filed: Mar. 12, 2003

(65) Prior Publication Data

US 2004/0000507 A1 Jan. 1, 2004

(30) Foreign Application Priority Data

Jun. 26, 2002 (BR) ..... 0202413

(51) Int. Cl.
*C10G 45/00* (2006.01)

(52) U.S. Cl. ..... 208/209; 208/210; 208/211; 208/212; 208/213

(58) Field of Classification Search ..... 208/213, 208/209, 210, 211, 212
See application file for complete search history.

(56) References Cited

U.S. PATENT DOCUMENTS 2,070,295 A 2/1937 Morrell
2,793,170 A 5/1957 Stiles et al.
3,957,625 A 5/1976 Orkin
4,149,965 A 4/1979 Pine et al.
4,334,982 A 6/1982 Jacquin et al.
4,397,739 A 8/1983 Jackquin et al.
5,348,928 A * 9/1994 Kukes et al. ..... 502/306
5,597,476 A 1/1997 Hearn et al.
5,906,730 A 5/1999 Hatanaka et al.
6,024,865 A 2/2000 Alexander et al.
6,126,814 A 10/2000 Lapinski et al.
6,228,254 B1 5/2001 Jossens et al.
6,893,554 B2 * 5/2005 Brignac et al. ..... 208/217

* cited by examiner

*Primary Examiner*—Glenn Caldarola
*Assistant Examiner*—John Douglas
(74) *Attorney, Agent, or Firm*—Sughrue Mion, PLLC

(57) ABSTRACT

A process for the hydrodesulfurization of cracked olefin streams is described, the process aiming at reducing the sulfur content while at the same time minimizing the hydrogenation degree of said olefins. In order to dilute the added reaction hydrogen, the process makes use of non-reactive compounds such as $N_2$, $CH_4$, $C_2H_6$, $C_3H_8$, $C_4H_{10}$, Group VIII noble gases as well as admixtures of same in any amount, in gas or vapor phase.

13 Claims, 2 Drawing Sheets

PROCESS FOR THE SELECTIVE HYDRODESULFURIZATION OF OLEFINIC NAPHTHA STREAMS

FIELD OF THE INVENTION

The present invention relates to a process for the selective hydrodesulfurization of olefins naphtha streams, whereby the choice of selected conditions in the presence of a hydrodesulfurization catalyst makes possible to lower the sulfur content of the said streams. More specifically, the present Invention refers to a process for the hydrodesulfurization of olefins streams which comprises the conversion of sulfur from cracked naphtha streams, the hydrogenation of olefins compounds being minimized through dilution of make-up hydrogen with non-reactive compounds.

BACKGROUND OF THE INVENTION

In view of present environmental regulations, the gasoline specification for sulfur content is becoming limited to lower levels. The main source of sulfur in gasoline is catalytic cracked naphtha, which can present typical values of 1,000 to 1,500 ppm wt, depending on FCC feedstock properties and operation conditions.

The conventional fixed bed hydrodesulfurization process (HDS) allows the attainment of low sulfur contents, but implies in the undesirable hydrogenation of olefins present in FCC naphtha, resulting in octane losses of the final gasoline pool.

Several selective hydrodesulfurization technologies have been developed, where selectivity means the ability to remove sulfur with minimum olefins hydrogenation.

At first, it was discovered that the composition of lower boiling point naphtha cuts showed lower sulfur and higher olefins content, while higher sulfur and lower olefins content were observed in heavier naphtha streams.

To take advantage of the olefins and sulfur distribution over the boiling point range, a technology was developed, which comprises splitting naphtha into a light and a heavy cut, promoting the desulfurization of the heavy cut, followed by the recombination of the light and the desulfurized naphtha. U.S. Pat. Nos. 3,957,625, 4,397,739 and 2,070,295 describe such a process.

Current HDS catalyst processes of olefinic naphtha feedstocks employ group VI transition metal oxides ($MoO_3$ being preferred) and group VIII transition metal oxides (CoO being preferred), in sulfided form during operation conditions, deposited on a proper porous support.

More preferably, the acidity of said support may be lowered by the use of a metal additive, or present a low intrinsic acidity composition, as taught in U.S. Pat. Nos. 3,957,625, 4,334,982 and 6,126,814, which also consider different contents of selective metals as well as optimal metal ratio. Such catalyst properties favor HDS against the olefins hydrogenation function.

U.S. Pat. No. 2,793,170 suggests that lower pressures are favorable to a lower olefins hydrogenation, while not affecting the HDS reactions to the same extent. This patent also claims that, due to the recombination of $H_2S$ and mercaptans with the remaining olefins, reverse reactions, besides the sulfur removal reactions leading to $H_2S$ also occur, leading to formation of mercaptans (R—SH) and sulfides (R—S—R). Such reactions render difficult to accomplish lower sulfur contents without promoting at the same time olefins hydrogenation reactions to a critical extent.

Two-reactor process schemes with intermediate $H_2S$ removal are used to overcome the said recombination, as taught in U.S. Pat. No. 5,906,730.

Different two-reactor processes were also granted, where, in order to convert the mercaptans formed by recombination in the first reactor (U.S. Pat. No. 4,397,739), the second reactor is operated at a higher temperature.

Besides the process designs with more than one reactor, with or without intermediate fractionation, post-treatments are proposed in the literature, like the mercaptan sulfur extraction, see U.S. Pat. No. 6,228,254 and references cited therein.

In the main reactor of the two-reactor process, typical pressure range is of from 0.5 to 4.0 MPag, preferably of from 2.0 to 3.0 MPag. Temperatures in the range from 200° C. to 400° C. are considered, a preferred range extending from 260° C. to 340° C. The preferred space velocity (hourly processed volume per catalyst volume) or LHSV extends from 1 $h^{-1}$ to 10 $h^{-1}$. The hydrogen/feed ratio ranges of from 35 $Nm^3/m^3$ to 1800 $Nm^3/m^3$, with a preferred range being of from 180 $Nm^3/m^3$ to 720 $Nm^3/m^3$. The hydrogen purity is not usually claimed as an objective of the invention, being considered usually above 80%.

In spite of the numerous processes described in the art, there is a renewed interest in techniques for the sulfur removal of olefinic feedstocks. There are significant higher capital and operating expenses in a naphtha splitter, which can also limit the maximum sulfur removal, as some sulfur remains in the light naphtha.

Alternative processes have been proposed, as taught in U.S. Pat. No. 6,024,865 for the alkylation of thiophene sulfur to heavier compounds, which may lower the sulfur content of light naphtha.

Furthermore, the catalytic distillation of FCC naphtha is disclosed in U.S. Pat. No. 5,597,476, where diverse naphtha portions are subjected to different severity degrees.

In addition, reactive adsorption processes are considered in the current state-of-the-art technique.

The different process proposals demonstrate the relevance and difficulties inherent to the art of sulfur removal from olefin feedstocks. Therefore, the art still needs a HDS process able to reach maximum sulfur removal with minimum olefins hydrogenation, a result that can be attained according to the present invention by adding non-reactive diluent compounds to the hydrogen feed, such a process being claimed and described in the present invention.

SUMMARY OF THE INVENTION

The present invention relates to a process for the selective hydrodesulfurization of olefinic naphtha streams, with reduced olefins hydrogenation, the process comprising the following steps:

a) obtaining an admixture by combining the olefinic feedstock (1) to the recycle gas containing i) the hydrogen and ii) the non-reactive inert compound (3) and to the make-up hydrogen (2), in order that the total gas (hydrogen plus inert compounds)/feedstock ratio is comprised between 50 $Nm^3/m^3$ and 5,000 $Nm^3/m^3$ and the $H_2/(H_2+\text{inert compounds})$ ratio is comprised between 0.2 and 0.7;

b) submitting the resulting admixture of a) to a first heat transfer in a heat transfer means (4), where said admixture is heated by the reaction product (9), yielding a partially heated stream (5) and then to a subsequent heater (6), in order to completely vaporize said admixture so that it may attain the reaction temperature range, of from 260° C. to 350° C.;

c) processing the hot mixture resulting from b) in a hydrodesulfurization reactor (8), at a LHSV range of from 0.5 $h^{-1}$ to 20 $h^{-1}$, and pressures from 0.5 Mpag to 5.0 Mpag, so as to obtain a product stream (10);

d) in condenser (11), partially condensing product stream (10), resulting in a cold stream (12) from 20° C. to 80° C. to be fed to the high pressure separator (13), where said stream (12) is separated into a desired hydrodesulfurization product (14) and a gaseous effluent (15);

e) directing the hydrodesulfurization product (14) of d) to the final processing, and the gaseous effluent (15), containing mainly the inert compounds (3) and the hydrogen plus non-condensed hydrocarbons, to a $H_2S$ removal step (16);

f) in order to keep constant the concentration of the said inert compounds (3), compensating the inert compound (3) losses by an inert compound make-up (18) to the main gaseous stream (17);

g) recompressing in compressor (19) the resulting combined stream ((17 plus (18)) to the pressure condition of the recycle gas of non-reactive compounds and hydrogen (3).

Thus, the improvement provided for by the inventive process leads to the minimization of the olefins hydrogenation degree at the desired degree of hydrodesulfurization, compared to the previous art, the hydrodesulfurization reaction of the olefins feed being carried out in the presence of hydrogen which is diluted by non-reactive compounds which are gaseous or in the vapor phase under the reaction conditions.

DETAILED DESCRIPTION OF THE INVENTION

According to the process conditions of the present invention, the reaction is such that the feedstock is completely vaporized. In addition, the hydrogen make-up is higher than its consumption, resulting in a measurable $H_2$ composition on the reactor gas effluent.

It is well known by the experts that the decrease in the total reactor pressure yields a lower olefins hydrogenation, but also a lower sulfur removal. On the other hand, higher hydrogen/feed ratios mean lower sulfur formed by product recombination, this being probably caused by less $H_2S$ at the reactor outlet but may also result in a higher, undesirable olefins hydrogenation.

The basic concept of the present invention involves reducing the hydrogen partial pressure while keeping the usual overall pressure conditions as well as the same or lower hydrogen/feedstock ratios, which led to unexpected, more selective results.

Thus, an inert make-up stream is added to the recycle and make-up hydrogen, said inert make-up stream having desirably a low olefins and sulfur content, and more desirably the composition of same is free of sulfur and olefins. Acording to the present invention the term "non-reactive compounds" involves a composition that exhibits at least 90 volume % of non-reactive compounds under the HDS reaction conditions.

Figure 1:
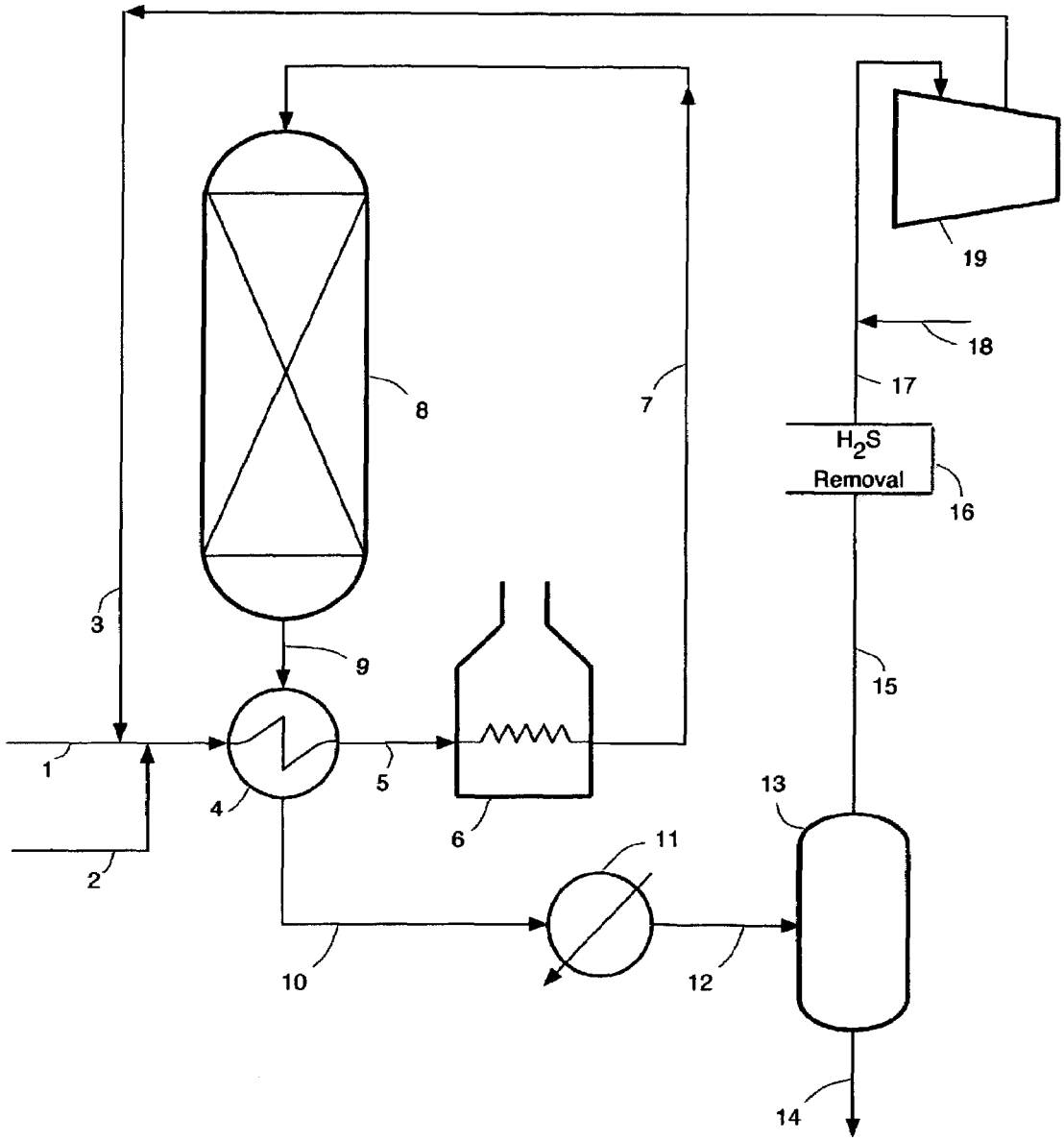
FIG. 1 attached show a simplified flow chart of one embodiment of the present process invention.

A preferred embodiment of the present invention is described in the simplified flow chart of FIG. 1.

a) Consider a typical FCC naphtha feedstock, having 30 vol % olefins, an equivalent bromine number of 65 g $Br_2$/100 g, and about 1300 ppm wt sulfur, which was previously hydrogenated under mild conditions to lower its diene content. The feedstock is combined to i) the hydrogen-containing recycle gas and ii) the non-reactive compound (3) and to the make-up hydrogen. Considering the sum of the hydrogen and the diluent in the feed (streams 2 and 3), the desirable ratios are total gas ($H_2$+inert compounds)/feed of from 300 $Nm^3/m^3$ to 900 $Nm^3/m^3$ and a $H_2/(H_2$+inert compounds) ratio of 0.2 to 0.7.

Alternatively, if the feedstock (1) originates from a selective hydrogenation, in a preferred manner it could have been previously combined with a make-up hydrogen stream, previously to a diene hydrogenation reactor A preferred non-reactive compound is $N_2$. Other compounds that can be considered useful to the present invention are light saturated hydrocarbons in $C_1$ to $C_4$, heavier hydrocarbons ($C_5$, $C_5$+), group VIII noble gases, or the blending of these compounds in any amount, provided they are in vapor phase at the reactor conditions.

b) The combined naphtha, recycle gas and make-up hydrogen stream is submitted to a first heat exchange in a heat exchanger (4), preferably with the reactor effluent (9), resulting in a partially or completely vaporized stream (5), which is directed to a further furnace (6) to attain the reaction conditions. In furnace (6) the feed stream (7) reaches the desired temperature from 260° C. to 350° C., and is then fed to the HDS reactor (8).

c) In reactor (8), the feed is hydrodesulfurized and the undesirable olefins hydrogenation reaction occurs. The initial temperature is of from 260° C. to 350° C., and there is a temperature profile due to the reaction heat, mainly due to the olefins hydrogenation reactions. Depending on the temperature increase, there is a need to provide more than one catalyst bed, with a hydrogen (or hydrogen and inert mixture or just inert gas) quench previously to the next bed.

Furthermore, the beds can be split up in more than one reactor. Preferably, due to the lower hydrogenation degree, the optimal operation conditions would dispense with the need of more than one reactor. Due to a higher specific heat, the diluent compounds as well impart the desired effect of lowering the temperature compared to pure hydrogen.

Reactor (8) is filled with catalysts known by those skilled in the art, preferably CoMo sulfided catalysts supported on alumina or on a lower acidity support. In a preferred embodiment, the reaction mixture is fed to the top, and withdrawn at the bottom, of reactor (8).

The catalyst amount filled in the reactor is such that the LHSV is from 1 $h^{-1}$ to 10 $h^{-1}$, more preferably from 2 $h^{-1}$ to 5 $h^{-1}$.

d) After the passage through reactor (8), products (9) are cooled in heat exchanger (4), further cooled in condenser (11), resulting in a cold 20° C. to 80° C. stream (12), which is fed to the high pressure separator (13). The preferred pressure range of the high-pressure separator—and the reactor pressure—is from 0.5 MPag to 5.0 MPag, more preferably from 1.0 MPag to 3.0 MPag.

e) from the high pressure separator (13) the liquid product is directed to a further, lower pressure separator and a stripping column for stabilization, both of them not represented in the figure, where the naphtha-soluble light compounds (e.g. $H_2$ and $H_2S$) are removed (and may be directed to stream (15)). Gaseous stream (15) from the high-pressure separator (13) containing non-reacted hydrogen, non-condensed hydrocarbons and inert compounds is preferably directed to a $H_2S$ removal section (16). At this point, some of the diluent compounds may also be purged.

Additionally, there may be preferably excess hydrogen during the HDS reaction, so that there is more than 10 vol % $H_2$ in the high-pressure separator gas stream (15). A $H_2S$ removal step on the recycle gas is a preferred embodiment of the present invention.

In case there is no $H_2S$ removal step on the recycle gas; there is preferably a purge to reduce the $H_2S$ concentration in the recycle.

f) In order to keep the concentration of non-reactive diluent compounds (3) in the recycle gas, further amounts (18) of said non-reactive compounds (3) are added at (17) in a continuous or intermittent mode, but preferably upstream of the recycle compressor (19), where the admixture of hydrogen and non-reactive compounds is recompressed up to the pressure condition of the line containing the said compounds (3).

At this stage hydrodesulfurized, low-sulfur (preferably lower than 300 ppm), low olefins hydrogenation degree (lower than 50% of the original olefins in the feed) FCC naphtha is obtained.

It should be understood that the flowchart illustrated in FIG. 1 depicts only one, among other possible arrangements of industrial process modes of the invention, without however limiting it in any way.

Figure 2:
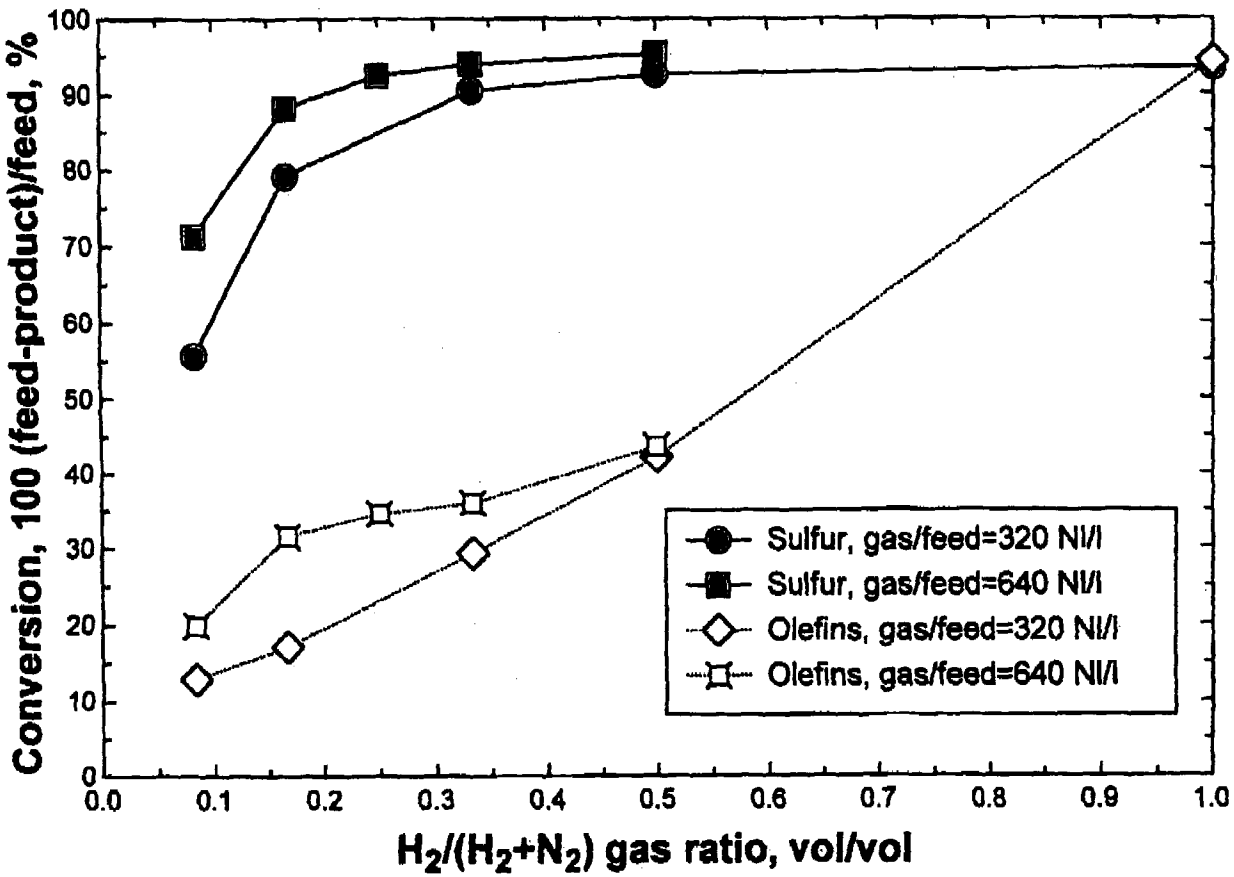
FIG. 2 attached show the effect of the total gas (hydrogen plus non-reactive compounds)/feed ratio and the hydrogen/gas ratio on the hydrodesulfurization and olefins hydrogenation reactions.

As regards the purposes of the present invention the Applicant considers that the reduction in sulfur level as well as the minimization observed for the hydrogenation of cracked streams feed olefins are suitably represented by the results illustrated in FIG. 2.

In FIG. 2, it can be seen that the addition of the inert compound significantly lowered the olefins hydrogenation, without affecting to the same level the sulfur removal. In FIG. 2, the conversion of sulfur and olefins are ploted against the $H_2/(H_2+N_2)$ ratio, at two total gas/feed ratios (320 NI/I and 640 NI/I). At no nitrogen condition, most of the olefins where converted, and, replacing the hydrogen for nitrogen, the sulfur conversion decreased much more slightly than the much more significant olefin conversion decrease.

In case non-reactive compounds are in the vapor phase under the condensation conditions downstream of reactor (8), they preferably exhibit limited solubility in the final product, and may be directed together with the remaining hydrogen to a H2S removal step.

Consumed hydrogen as well as the non-reactive compounds lost by being soluble in the final product in the high pressure separator should be made up, so that the recycle gas composition may be kept constant and the recycle compressor works under optimum operation conditions.

Addition of non-reactive compounds may be carried out in an intermittent or continuous mode. Process arrangements to effect recycle are fully known by the experts and as such do not involve an inventive step.

It is possible to set upper limits for the concentration of inert compounds (3), as well as adding or purging inert compounds so as to control the concentration level.

Therefore the invention may set concentration levels for the diluent or non-reactive compounds in (3) as well as addition or purge of such compounds may be practiced.

Further, low-pressure recycle of non-reactive compounds as well as hydrogen purge are also within the objectives of the invention.

Still, a continuous injection and purge of non-reactive compounds may be considered, provided means are made available to separate hydrogen from the non-reactive compounds, with hydrogen only being recycled.

A further alternative is to use low-purity catalytic reform hydrogen as a source of hydrogen and non-reactive compound addition.

Also within the scope of the inventive process are: a) heat exchange means which lead the mixture of non-reactive gas plus hydrogen to the reaction conditions; b) means to direct the reagents to the hydrodesulfurization reactor (8); c) means to separate the products from the gas (this latter being the recycle gas or not) and d) means to remove $H_2S$ from the recycle gas, if ever required.

Further, the injection of hydrogen to be consumed in the reaction may be controlled by the composition of the recycled mixture of hydrogen plus non-reactive compounds.

It should be understood that such recycling procedures, by-products removal and fluid transport do not involve any inventive step.

According to the present invention, the vaporization of most of the feed should occur as a first option in a heat exchanger upstream of the furnace with or without admixing with the recycle gas.

Alternatively, the recycle gas may be separately heated, so as to be admixed to the feed to increase the temperature of the resulting stream up to the range of 260° C. to 350° C. This is a means to minimize the build up of coke in the heat exchangers and furnaces upstream reactor (8).

Means for removing $H_2S$ from the recycle gas include diethanolamine (DEA) or monoethanolamine (MEA) absorption units, besides caustic wash outs and adsorption units. If the solubility of $H_2S$ in the product at the high pressure separator (13) condition is high, there can be even no need of employing a $H_2S$ removal unit.

In case the non-reactive compound is condensed under the operation conditions of the high pressure separator, it is easily distilled off the naphtha, decanted or crystallized, or even compounded with the gasoline pool. As non limiting examples may be cited straight distillation naphtha, aviation kerosene, alkylate, isomerized naphtha, reform naphtha and aromatics.

The composition of combined gas (non reactive compound plus hydrogen) may be in the range of from 5% to 95% vol/vol (volume of non-reactive compound divided by the volume of hydrogen plus the volume of non reactive compound), but preferably is between 20% and 80% vol/vol, and still more preferably, between 25% to 70% vol/vol.

Suitable conditions for carrying out the present process include pressures between 0.5 MPag to 5.0 MPag, more preferably 1.0 MPag to 3.0 MPag, and still more preferably 1.5 MPag to 2.5 MPag absolute pressure.

The temperature range extends from 200° C. to 420° C., more preferably from 250° C. to 390° C., and still more preferably from 260° C. to 350° C. average temperature in reactor (8).

The volume of combined gas per volume of processed feed is in the range of from 50 $Nm^3/m^3$ to 5,000 $Nm^3/m^3$, more preferably of from 150 $Nm^3/m^3$ to 2,000 $Nm^3/m^3$, and still more preferably of from 300 $Nm^3/m^3$ to 900 $Nm^3/m^3$.

A typical feedstock of the present invention is the FCC naphtha, with 60% or less olefinic hydrocarbons and 7000 ppm or less sulfur. Other feedstocks useful in the process of invention includes steam cracked naphthas and coker naphthas. The naphtha final boiling point is generally lower than 240° C. In a preferred embodiment of the present invention, the feedstocks have been previously hydrogenated in mild conditions to a diene content of less than 1.0 g $I_2$/100 g.

The catalyst useful for the present invention comprises current hydroprocessing catalysts, those being a mixture of Group VIII and Group VI metal oxides supported on alumina, which in sulfided state under the reaction conditions. More typically, the catalyst will comprise a non-noble group VIII metal, such as Co, Ni and Fe, and preferred group VI metals are Mo and W. Usually employed are those catalysts that contain, previously to sulfiding, Ni or Co oxides plus Mo deposited on a suitable support. More preferably, CoO plus $MoO_3$ leads to a better hydrodesulfurization performance than NiO plus $MoO_3$. Typical metal content is from 0 to 10 wt % CoO, and 2 to 25 wt % $MoO_3$.

A typical support is an inorganic metal oxide such as, but not limited to, alumina, silica, titania, magnesia, silica-alumina, and the like. A preferred support is alumina, silica-alumina and alumina/magnesia mixed supports. More preferentially, the support has an intrinsic lower acidity, such as the alumina magnesia mixed oxide, or had its acidity lowered by the utilization of additives such as alkaline group I metals or alkaline earth group II metals.

Further, the mixture of several catalysts in the hydrodesulfurization reactor (8) is equally included in the objectives of the invention.

The catalysts may have been deactivated through previous use in a different hydrorefining unit, i.e., could have been cascaded from another hydroprocessing unit, such as a diesel hydrotreater.

Without being bound to any particular theory, the Applicant believes that at least part of the desired, novel effect herein described derives from the reduced hydrogen concentration combined to the $H_2S$ dilution having origin in the hydrodesulfurization reactions.

Still, there may be an adsorption effect of the supposed non-reactive compound on the support or on the catalyst site, so as to promote the relative reduction of the olefin hydrogenation effect on the sulfur compounds hydrodesulfurization.

Finally, there is the effect of reduced olefin and hydrogen concentration caused by dilution.

Further interpretations on the nature and mechanism of the increased selectivity resulting from the present process do not alter the novelty of the present application which will now be illustrated by the following Examples, which should not be construed as limiting same.

EXAMPLE 1

This Example refers to the present state-of-the-art technique.

A naphtha produced by catalytic cracking of a gasoil from a Marlim crude was fractionated by separating 25 volume % of the lighter portion, having higher olefin content and lower sulfur than the heavier naphtha cut. Sulfur content and bromine number are listed in Table 1 below. Naphtha boiling point range is between 70° C. and 220° C.

Heavy naphtha was processed in an hydrodesulfurization reactor working under isothermal conditions through controlled heating zones. The reactor was fed with 50 ml of a previously employed, deactivated CoMo catalyst (2.5% CoO and 18% w/w $MoO_3$) supported on trilobe $Al_2O_3$, having 1.3 mm diameter.

The catalyst of this Example was previously sulfided and stabilized before processing the olefin feed. Feed and product properties are listed in Table 1. Temperature was set at 310° C., hydrogen (of higher than 99% purity) to feed volumetric ratio was 160 NI/I, space velocity 3 $h^{-1}$ (feed volume per hour per catalyst volume), with the pressure at the reactor outlet being varied.

The Selectivity Factor (S.F.) was previously set forth in U.S. Pat. No. 4,149,965, being defined as the ratio between the constant of the hydrodesulfurization rate and the constant of the hydrogenation rate.

$$\text{Selectivity Factor} = \frac{\frac{1}{\sqrt[3]{S_{product}}} - \frac{1}{\sqrt[3]{S_{feed}}}}{\text{Ln}\left(\frac{Br_{feed}}{Br_{product}}\right)}$$

Wherein $S_{product}$ and $S_{feed}$ are respectively the sulfur contents of the product and the feed, in ppm, while $Br_{product}$ and $Br_{feed}$ are respectively the bromine numbers of the feed and product, in $gBr_2/100$ g. Thus, a higher value for the Selectivity Factor means a higher HDS rate relative to the olefins hydrogenation rate. Table 1 below lists the properties of the desulfurized naphtha streams of Example 1.

TABLE 1

| RUN | Pressure MPag | Sulfur ppm | Bromine g $Br_2$/100 g | S.F. (×10) |
|---|---|---|---|---|
| Feed | — | 1602 | 55 | |
| Test 1 | 1.0 | 223 | 25.1 | 1.01 |
| Test 2 | 2.0 | 142 | 19.4 | 1.02 |
| Test 3 | 2.8 | 79.9 | 15.7 | 1.17 |
| Test 4 | 3.2 | 27.4 | 8.9 | 1.35 |

From the above Example it may be observed that in spite of the fact that olefin conversion, as represented by the bromine number results, is greatly reduced as a function of the lower pressure, the sulfur conversion exhibited by the product is also significantly affected. Figures for the Selectivity Factor indicate that in spite of the lower olefin conversion the mere pressure reduction lowers the catalyst selectivity for sulfur withdrawal.

EXAMPLE 2

This Example illustrates a test of the invention concept on a commercial catalyst.

The same naphtha feed from the catalytic cracking of Example 1 was used, without any fractioning. A naphtha stream having a sulfur content of 1385 ppm was processed in an isothermal reactor at a pressure of the rector outlet set at 2.0 MPag and a controlled temperature of 280° C. throughout the reactor. A commercial CoMo catalyst of 1.3 mm diameter having 17.1% MoO3 and 4.4% CoO supported on $Al_2O_3$ trilobe was used. The catalyst was previously sulfided and stabilized before processing the olefinic feed. Nitrogen was used as non-reactive compound.

Table 2 below lists the properties of the feed as well as of the obtained desulfurization products.

TABLE 2

| Run | $H_2/(H_2 + N_2)$ Ratio, v/v | gas/feed NI/I | S content ppm | Bromine Nr. g $Br_2$/100 g | S.F. (×10) |
|---|---|---|---|---|---|
| Feed | — | — | 1385 | 68.7 | |
| Test 1 | 1 | 320 | 90 | 3.9 | 0.47 |
| Test 2 | 1/2 | 320 | 102 | 39.7 | 2.27 |
| Test 3 | 1/3 | 320 | 132 | 48.6 | 3.08 |
| Test 4 | 1/6 | 320 | 290 | 56.9 | 3.26 |

TABLE 2-continued

| Run | $H_2/(H_2 + N_2)$ Ratio, v/v | gas/feed NI/I | S content ppm | Bromine Nr. g $Br_2$/100 g | S.F. (×10) |
|---|---|---|---|---|---|
| Test 5 | 1/12 | 320 | 613 | 59.8 | 2.02 |
| Test 6 | 1/2 | 640 | 65.3 | 38.7 | 2.76 |
| Test 7 | 1/3 | 640 | 83.2 | 43.9 | 3.11 |
| Test 8 | 1/4 | 640 | 104 | 44.9 | 2.89 |
| Test 9 | 1/6 | 640 | 164 | 47.1 | 2.46 |
| Test 10 | 1/12 | 640 | 398 | 55.0 | 2.08 |

FIG. 2 shows the results in terms of conversion. It may be observed that nitrogen addition significantly reduced olefin hydrogenation, without significantly altering sulfur withdrawal. The lower activity for sulfur withdrawal was perceptible starting from the ⅓ $H_2/(H_2+N_2)$ ratio and the 320 NI/I gas/feed ratio and from the $H_2/(H_2+N_2)$ ratio at the 640 NI/I gas/feed ratio.

Results indicate a significant improvement in selectivity, which would not be expected based on the mere lowering of total pressure under reaction conditions, as evidenced in Example 1.

It is observed that the introduction of the non-reactive compound significantly reduces olefin hydrogenation, with at the same time a meager effect on sulfur removal. It is further observed that a higher gas/feed ratio meant an increase in sulfur conversion.

EXAMPLE 3

This Example illustrates the concept of the invention as applied to different non-reactive or inert compounds.

In this Example the same catalytic cracking naphtha of Example 2 was used. After the tests presented in Example 2, the following tests were applied on the same catalyst system and reactor. Sulfur content of the employed naphtha was 1385 ppm and it was processed in an isothermal reactor, at a pressure set at the reactor outlet at 2.0 MPag and 280° C. temperature, a ($H_2$+non-reactive compounds)/naphtha set at 320 NI/I and a $H_2/(H_2$+non-reactive compounds) ratio set at 0.5 vol/vol.

Table 3 below lists the properties of the feed as well as the desulfurization products after $H_2S$ removal of the liquid product, the non-reactive compounds being other than $N_2$.

TABLE 3

| Run | non-reactive compound | S content ppm | Bromine Nr. g $Br_2$/100 g | S.F. (×10) |
|---|---|---|---|---|
| Feed | — | 1385 | 68.7 | |
| Test 1 | none | 90 | 3.9 | 0.47 |
| Test 2 | $N_2$ | 102 | 39.7 | 2.27 |
| Test 11 | methane | 100 | 35.1 | 1.87 |
| Test 12 | propane | 98 | 38.3 | 2.18 |
| Test 13 | admixture | 99 | 35.5 | 1.92 |

The non-reactive admixture of Test 13 was made up of 80% methane, 15% ethane and 5% propane, this being a typical natural gas composition.

It may be observed that the desired effect of selectivity increase was noticed not only for nitrogen but also for the several non-reactive compounds, either alone or in admixture.

Therefore, experimental results as well as the considerations set forth in the present specification evidence the improved process selectivity brought about by the present invention.

We claim:

1. A process for the selective hydrodesulfurization of olefinic streams to reduce the sulfur content of cracked olefinic streams, while minimizing the hydrogenation degree of the olefins present in said streams, comprising:

a) obtaining an admixture by combining the olefins feedstock (1) to the recycle gas (3) containing i) the hydrogen and ii) the non-reactive inert compound and to the make-up hydrogen (2), in order that the total gas (hydrogen plus inert compounds)/feedstock ratio in the admixture is comprised between 50 $Nm^3/m^3$ and 5000 $Nm^3/m^3$ and the $H_2/(H_2$+inert compounds) ratio in the admixture is comprised between 0.2 and 0.7;

b) submitting the resulting admixture of a) to a first heat transfer in a heat transfer means (4), where said admixture is heated by the reaction product (9), yielding a heated stream (5) and then to a subsequent heater (6), in order to completely vaporize said admixture so that it may attain the reaction temperature range, of from 260° C. to 350° C.;

c) processing the hot mixture resulting from b) in a hydrodesulfurization reactor (8), at a LHSV range of from 0.5 $h^{-1}$ to 20 $h^{-1}$, and pressures from 0.5 Mpag to 5.0 Mpag, so as to obtain a product stream (10);

d) partially condensing in condenser (11) the product stream (10), resulting in a cold stream (12) from 20° C. to 80° C. to be fed to the high pressure separator (13), where said stream (12) is separated into a desired hydrodesulfurization product (14) and a gaseous effluent (15);

e) directing the hydrodesulfurization product (14) of d) to the final processing, and the gaseous effluent (15), containing mainly the inert compounds and the hydrogen plus non-condensed hydrocarbons, to a $H_2S$ removal step (16);

f) compensating the inert compound losses by an inert compound make-up (18) to the main gaseous stream (17), in order to keep a constant concentration of the said inert compounds; and g) recompressing in compressor (19) the resulting combined stream ((17 plus (18)) to the pressure condition of the recycle gas of non-reactive compounds plus hydrogen (3).

2. A process according claim 1, wherein the non-reactive compounds are gases or vapors, under the process hydrodesulfurization conditions.

3. A process according to claim 2, wherein the composition of the nonreactive compounds exhibit at least 90% by volume of non-reactive compounds under the hydrodesulfurization process conditions.

4. A process according to claim 3, wherein the non reactive compounds comprise $N_2$, $CH_4$, $C_2H_6$, $C_3H_8$, $C_4H_{10}$, heavier hydrocarbons ($C_5$, $C_5$ plus), group VIII noble gases and admixtures of same in any amount.

5. A process according to claim 4, wherein the sulfur content of non-reactive compounds is lower than 500 ppm and the olefin content is lower than 10 wt %.

6. A process according to claim 1, wherein most of the non-reactive compounds are separated from the hydrodesulfurization reactor products.

7. A process according to claim 1, wherein the olefin stream is a catalytic naphtha stream, having of from 10 to 70 wt % olefins, equivalent bromine number of from 20 g $Br_2$/100 g to 140 g $Br_2$/100 g and sulfur content in the range of from 300 ppm to 7,000 ppm.

8. A process according to claim 1, wherein the purity of added hydrogen is low, of the order of 50 to 80% by volume.

9. A process according to claim 1, wherein reactor (8) comprises therein a catalyst containing at least one group VIII metal component and at least one group VI metal, both on a support.

10. A process according to claim 9, wherein a metal content as oxides on the catalyst support is in the range of 0.5 to 30 wt %.

11. A process according to claim 10, wherein the metals are cobalt and molybdenum.

12. A process according to claim 11, wherein the support for the active metals contains alumina.

13. A process according to claim 12, wherein the support contains further group I alkaline earth metal oxides and group II alkaline earth metal oxides, in an amount of from 0.05 to 50 wt % of the support.

* * * * *